United States Patent [19]

Stevenson

[11] 4,124,480

[45] Nov. 7, 1978

[54] BIPOLAR CELL

[75] Inventor: David G. Stevenson, New Town Near Newbury, England

[73] Assignee: Paterson Candy International, Limited, London, England

[21] Appl. No.: 768,097

[22] Filed: Feb. 14, 1977

[30] Foreign Application Priority Data

Feb. 17, 1976 [GB] United Kingdom ..... 6121/76

[51] Int. Cl.[2] ..... C25B 9/00

[52] U.S. Cl. ..... 204/268; 204/255

[58] Field of Search ..... 204/268, 254, 255, 269, 204/257, 95, 275; 429/210

[56] References Cited

U.S. PATENT DOCUMENTS

| | | | |
|---|---|---|---|
| Re. 25,913 | 11/1965 | Solomon et al. | 429/210 X |
| 3,219,563 | 11/1965 | Collins et al. | 204/268 X |
| 3,312,614 | 4/1967 | Schick | 204/255 X |
| 3,669,869 | 6/1972 | Burton | 204/268 |
| 3,682,809 | 8/1972 | Marquardson et al. | 204/269 X |
| 3,790,464 | 2/1974 | Greaves | 204/268 X |
| 3,893,902 | 7/1975 | Loftfield et al. | 204/275 X |
| 3,994,798 | 11/1976 | Westerlund | 204/268 |

*Primary Examiner*—Charles F. Lefevour
*Attorney, Agent, or Firm*—Brown, Murray, Flick & Peckham

[57] ABSTRACT

A bipolar cell comprising a plurality of spaced electrode plates defining a sinuous flow path therethrough, wherein the flow path sweeps out the entire space between adjacent plates so as substantially to prevent the formation of stagnant areas and thus minimize the growth of precipitate between the plates.

4 Claims, 5 Drawing Figures

BIPOLAR CELL

Figure 1:
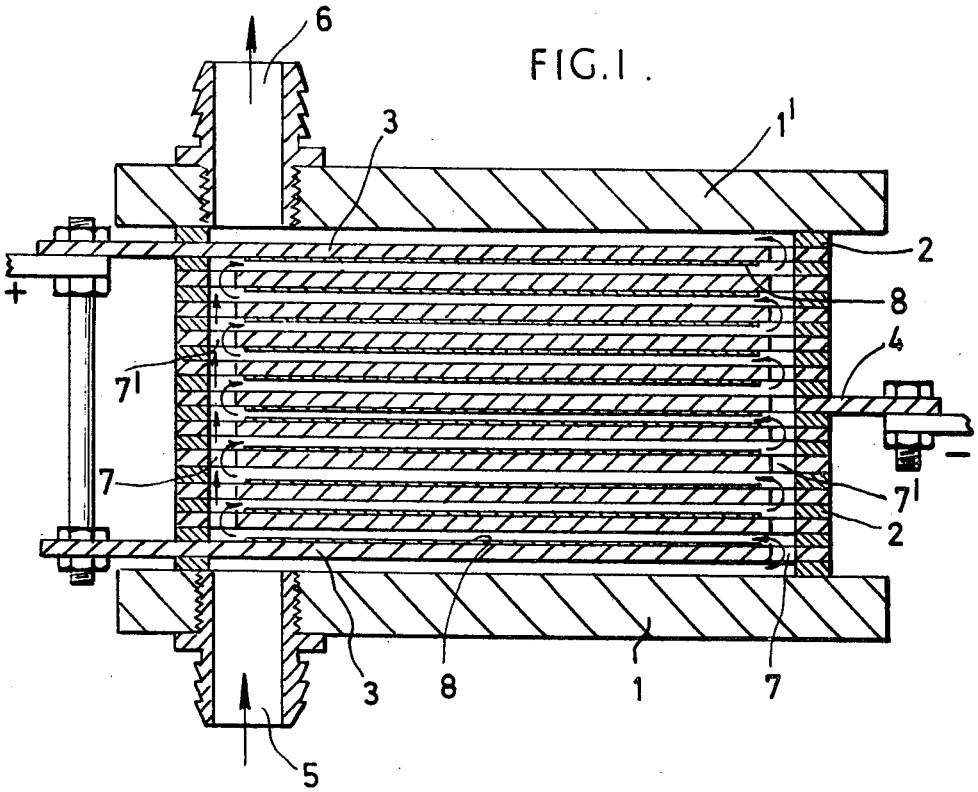

The present invention relates to a bipolar cell, particularly but not exclusively for the manufacture of sodium hypochlorite.

Sodium hypochlorite is commonly prepared directly from sea water and similar brines by electrolysis in an unbaffled cell in which chlorine is liberated at the anode and caustic soda at the cathode. The chloride and caustic soda combine in the common flow stream. Titanium is a common electrode material resistant to the chemical action but the anode is commonly covered with a noble metal, an alloy of noble metals or oxides of noble metals. Such coatings lower the voltage and improve the power performance, and at the same time protect the titanium substrate from attack by the chlorine liberated.

It is essential in such cells to ensure a good distribution of the electrolyte flow so that no stagnant areas develop. If such precautions are not taken, areas of the cathode may reach a sufficiently high pH to cause precipitation of magnesium hydroxide etc. Once this commences, a progressive growth occurs which can bridge the space between electrodes.

A further common feature of such electrolytic cells is the adoption of a stack of bipolar electrodes in which current is applied to the outer electrodes, and internal electrodes merely act as barriers between cells in series so that one face acts as an anode and the other face acts as a cathode. This enables considerable savings to be made in electrical gear as a result of the reduced current and higher voltage.

A problem of such a multiplate arrangement is the skip of electrical current across the ends of the plates which effectively causes very high current densities to be applied to the edges of the end electrodes causing erosion and accelerating deposition and fouling.

An object of the present invention is to provide a cell in which one or more of the above-mentioned disadvantages is overcome or at least reduced.

The invention provides a bipolar cell comprising a plurality of spaced electrode plates defining a sinuous flow path therethrough, wherein the flow path sweeps out the entire space between adjacent plates so as substantially to prevent the formation of stagnant areas and thus minimise the growth of precipitate between the plates.

In a preferred embodiment each plate has a flow edge around which the flow path extends, the flow edges of adjacent plates being arranged in staggered relationship.

Preferably, the plates are substantially rectangular or square and the flow path extends around opposite edges of adjacent plates.

The opposite edges may be formed by slots cut out along opposite edge portions of adjacent plates, or alternatively by spacing opposite edges of adjacent plates from the wall of a container in which the electrode plates are stacked.

In an alternative preferred embodiment, the flow path extends from a substantially central aperture in one plate to a circumferential aperture in an adjacent plate. Preferably, the plates are circular or square.

Thus the liquid has an essentially sheet flow pattern and this reduces the risk of stagnation and hence deposition.

Preferably, the plates have a coating of a noble metal, an alloy of noble metals, or an oxide or oxides of noble metals, there being a portion around the periphery of each plate, said portion having, in use, a substantially lower current density.

The said portion may be formed by an uncoated peripheral coating of each plate, or by a non-conducting peripheral coating.

Preferably, the width of the peripheral portion is at least half the distance between adjacent plates, and preferably even greater.

Since the current flows mainly through the coated areas of each plate the current density at the edges of the plates is reduced to minimal proportions. Consequently, the formation of magnesium hydroxide and other deposits on the plates is further reduced or entirely eliminated.

Preferably, the two end electrodes are connected to a common potential (e.g. as anodes) and a central plate is connected to a different potential (e.g. as a cathode). Thus no stray electrical voltages will be present in the external electrolyte. Safety is therefore improved and the design of external pipework simplified.

The construction of such cells may take many forms, electrodes may be merely stacked between insulating gaskets with the edges exposed. Preferably they should be sealed with an insulating varnish. Equally electrodes may be housed in a "picture frame" of insulating material. The outer case may form its own pressure vessel or indeed it may be housed within an outer pressure vessel for high pressure operation.

Figure 2:
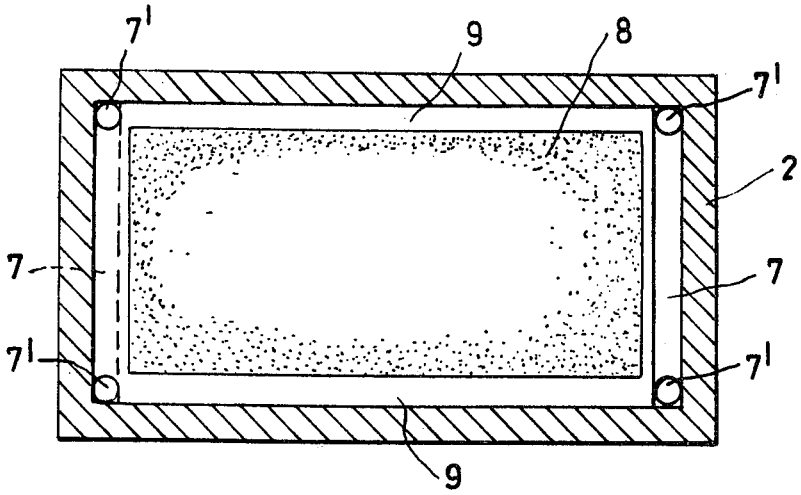
Figure 3:
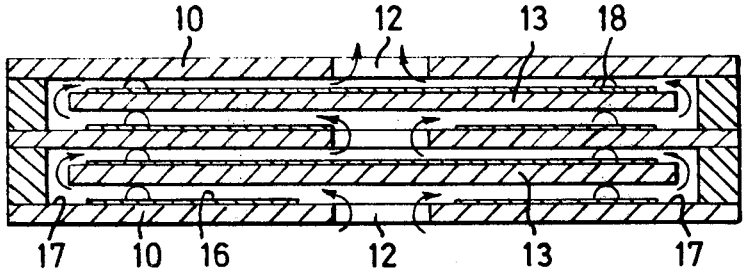
Figure 4:
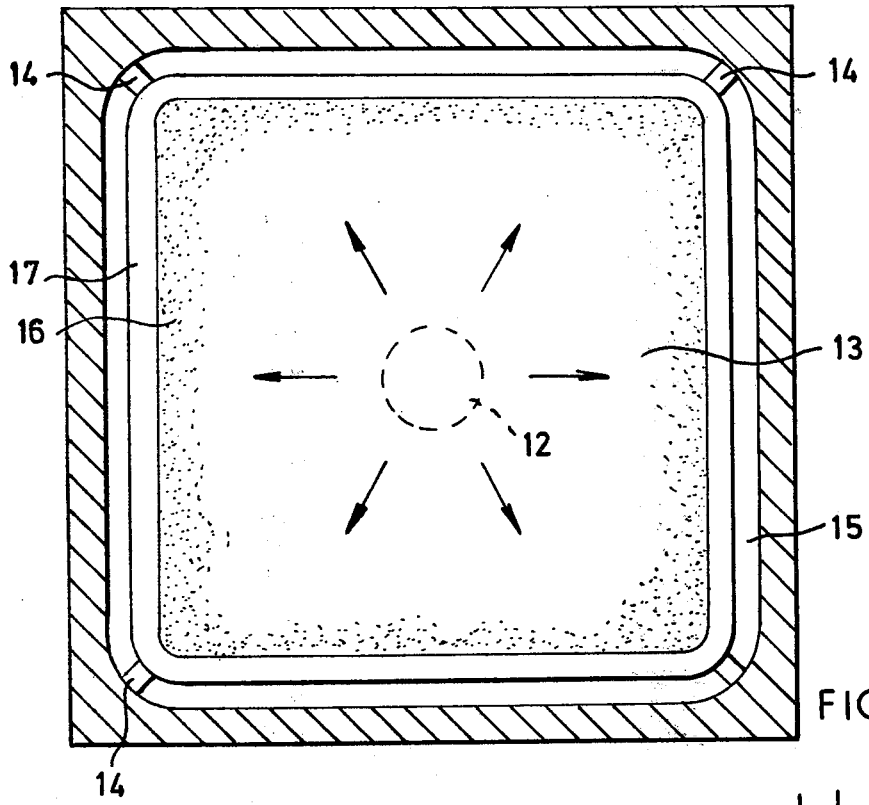
Figure 5:
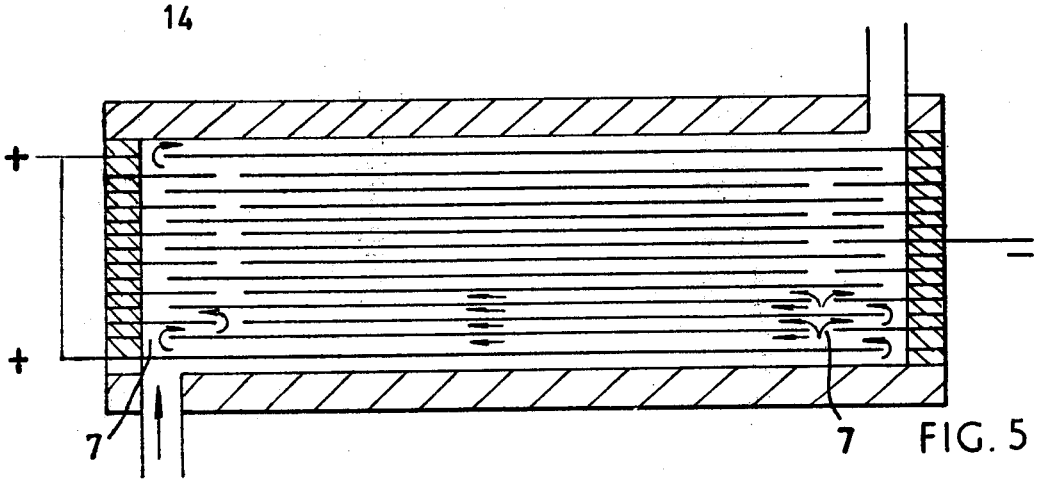

The invention will now be described with reference to embodiments shown by way of example in the accompanying drawings, wherein:

FIG. 1 is a section through a first embodiment of a cell according to the invention, FIG. 2 is a plan view of one of the plates of FIG. 1, FIG. 3 is a section through a second embodiment of a cell according to the invention, FIG. 4 is a plan view of a plate of FIG. 3, and FIG. 5 is a section of a third embodiment of a cell according to the invention.

In FIG. 1 a bipolar cell comprises eleven spaced plates contained between insulating end plates 1, 1' and separated by gaskets 2. Two outer plates 3 are connected to a common positive source and hence act as anodes, and the central plate 4 is connected to a negative source and hence acts as a cathode. Liquid enters through an inlet 5 in one of the insulating plates 1 and leaves through an outlet 6 in the other insulating plate 1'.

Each electrode plate has a slot 7 cut along one end so that liquid flows along each plate over the whole width thereof, through the slot 7 and back along the adjacent plate and also over the whole width thereof. Since the slot 7 also extends over the whole width of the plate the whole flow path between the plates is swept out by the liquid, which follows an unrestricted sinuous path through the plates. Thus the risk of liquid stagnation is substantially reduced.

However, flow at the edges between the plates tends to be more sluggish than the flow in the centre between the plates because of the additional drag produced by the gaskets 2. This in turn tends to reduce the flow at the ends of the slots 7 so that the fouling of the cathode, if this should occur, is more likely to commence adjacent to the ends of the slots. This may be prevented by providing holes 7' at the ends of the electrode opposite to the slots 7 so that a portion of the flow is able to bypass two of the cells. This bypass flow creates a local high velocity in what is otherwise a rather stagnant zone. The size of the holes is selected to allow a few percent of the flow to bypass in this manner. This has no effect on the performance of the electrode since the flow is not changed by a significant manner.

The plates may be of titanium having a coating 8 of a noble metal, an alloy of noble metals, or an oxide or oxides of noble metals. As can be seen more particularly from FIG. 2 the coating 8 does not extend over the entire surface of each plate, so that there is an uncoated peripheral portion 9. The current flows mainly through the coating 8 so that the current density at the edges of each electrode plate is reduced to a minimum. Thus the formation of magnesium hydroxide and other deposits is eliminated or at least considerably reduced. The width of the peripheral portion 9 may be, e.g. 2 to 6 times the distance between adjacent plates.

The above-described series flow arrangement prevents leakage of electric current across the ends of the plates, and each individual pair of electrodes behaves as if it were an isolated cell apart from the area adjacent to the slot where the electrolyte passes from one cell to the adjacent one.

In the cell of FIGS. 1 and 2 used for electrolytic generation of chlorine from sea water or similar brines, the following parameters are desirable:

Typical Current Density 0.15–0.5A/cm$^2$
Gap between plates 2–4 mm.
Reynolds Number 4–8000
Voltage 4.5–6V
Yield 3.0–5.5 Kw.Hr/Kg $Cl_2$
Coating Pt or Pt/Ir Alloy Thus a 30 plate $\times$ 900 cm$^2$ (each plate) cell would carry 450A at 0.5A/cm$^2$ and have a voltage around 170V across the stand (and end electrolyte space). In the present design the skip voltage cannot exceed 2 cell voltages, e.g. 11V. A 30 plate "Back to Back" cell would carry 900A at an overall voltage of 85V.

In the embodiments of FIGS. 3 and 4 the end plates and inlet and outlet have been omitted. In this embodiment the liquid flow is radial.

One set of plates 10 extend up to the surface of housing 11 and have central apertures 12 which may be, e.g. 30% the width of the plate. Another set of plates 13 is arranged between the plates 10. The plates 13 are spaced from the housing 11 by means of spacers 14 so that there is a peripheral gap 15 around each plate 13.

The flow pattern is as follows: Brine flowing upwards through the aperture 12 in the bottom plate 10 flows radially outwards to the peripheral gap 15 of the adjacent plate 13. The liquid flows through the entire gap 15 and radially inwards towards the aperture 12 of the next adjacent plate 10. Thus the flow path between the plates is again completely swept out by the electrolyte, there being no stagnant areas.

As in the previous embodiment the anode surface of each plate has a coating 16, there being an uncoated portion 17 around the whole periphery. The plates 10, 13 may be provided with spacer pips 18.

In both of the above-described embodiments the flow through the individual cells is in series. This arrangement is beneficial in that high velocities are achieved, which create turbulent flow. This reduces the tendency for encrustation of cathodic surfaces.

In certain cases however, e.g. when the brine contains very little calcium or magnesium, lower velocities in the laminar flow region produces a greater electrochemical efficiency. If the brine is merely fed in a parallel flow arrangement to a set of plates the above-mentioned problem of external short circuiting will be encountered. It is however possible to employ the labyrinth arrangement of FIGS. 1 and 2 as a means of preventing short circuiting in a parallel flow arrangement, by employing two such series flow labyrinths as shown in FIG. 5. All the features of the pure series flow design may be retained in such a parallel flow system. Because the flow through the transfer slots 7 is turbulent the flow in each cell will not be identical but with practical numbers of plates the error is relatively small.

I claim:

1. In a bipolar cell, a housing having an inlet in one side for liquid electrolyte and an outlet in the opposite side, and a stack of spaced electrode plates in the housing between said inlet and outlet with each plate having two opposite side edges and two ends, said side edges and said ends of each plate being in sealing contact with the housing, each plate having a slot near one end forming a flow edge extending across it spaced inwardly from the adjacent side of the housing, said slot connecting the opposite sides of the plate, and the slots being staggered relative to one another to form with the spaces between the plates a single sinuous electrolyte passage through said stack to thereby cause electrolyte entering said inlet at one side of the nearest plate to flow through the slot at the end of that plate and along the opposite side of the plate to and through the slot at the opposite end of the next plate and then back along the opposite side of said next plate to and through the slot at the end of the following plate and continuing back and forth between the rest of the plates in the same manner to said outlet, whereby a sinuous flow path through the spaces between adjacent electrode plates is established through the housing extending continuously from its inlet to its outlet so that electrolyte flowing through the housing will sweep out the spaces between the plates to substantially prevent formation of stagnant areas and thus minimize the growth of precipitate between the plates.

2. A bipolar cell according to claim 1, wherein each electrode plate is provided with bypass openings in its corners at the end of the plate opposite to its said slot.

3. In a bipolar cell according to claim 1, wherein the side walls of said housing are formed from gaskets engaging opposite sides of said electrode plates and spacing them apart, said side edges and ends of each plate are disposed in sealing contact with the two gaskets engaging that plate, and said flow edge of the plate is spaced inwardly from the adjacent side of said two gaskets.

4. In a bipolar cell according to claim 1, wherein the two outermost electrode plates in said stack are connected to a common potential, and a central electrode plate in the stack is connected to a different potential.

* * * * *